US005833044A

United States Patent [19]

Canzutti et al.

[11] Patent Number: 5,833,044

[45] Date of Patent: Nov. 10, 1998

[54] METHOD AND APPARATUS FOR MANIPULATING THE ORIENTATION OF WORKPIECES

[75] Inventors: Roberto Canzutti, Butttrio; Amy L. Woy, Canal Fulton; Tom J. Rodrick, Leetonia, all of Ohio

[73] Assignee: Republic Engineered Steels, Inc., Massillon, Ohio

[21] Appl. No.: 690,504

[22] Filed: Jul. 31, 1996

Related U.S. Application Data

[60] Provisional application No. 60/002,483, Aug. 18, 1995.

[51] Int. Cl.[6] ..... B65G 47/24

[52] U.S. Cl. ..... 198/413

[58] Field of Search ..... 198/410, 413, 198/785

[56] References Cited

U.S. PATENT DOCUMENTS

| | | | |
|---|---|---|---|
| 333,431 | 12/1885 | Treat | 198/413 |
| 483,644 | 10/1892 | Cunningham . | |
| 1,376,300 | 4/1921 | Thomas . | |
| 2,860,764 | 11/1958 | Barton | 198/413 |
| 3,157,071 | 11/1964 | Pachell . | |
| 3,184,077 | 5/1965 | Clark et al. . | |
| 3,323,632 | 6/1967 | Modder et al. | 198/413 |
| 3,645,376 | 2/1972 | Gewartowski . | |
| 3,738,143 | 6/1973 | Orris . | |
| 3,917,079 | 11/1975 | Jonsson . | |
| 4,106,647 | 8/1978 | Robert . | |
| 4,202,402 | 5/1980 | Rohrig . | |
| 4,422,543 | 12/1983 | Stubbings | 198/785 |
| 4,424,000 | 1/1984 | Sucato . | |
| 4,977,997 | 12/1990 | Takigawa et al. | 198/410 |
| 5,169,275 | 12/1992 | Kratz . | |

FOREIGN PATENT DOCUMENTS

| | | |
|---|---|---|
| 634386 | 8/1936 | Germany . |
| 10905/76 | 2/1976 | United Kingdom . |

OTHER PUBLICATIONS

Exerpts from "Continuous Cast Direct Billet Plant", Republic Engineered Steels, Oct 1993.

*Primary Examiner*—Joseph E. Valenza
*Attorney, Agent, or Firm*—Watts, Hoffmann, Fisher & Heinke Co., L.P.A.

[57] ABSTRACT

An apparatus for manipulating the orientation of a metal bloom supported on a conveyor, the bloom being elongated and substantially square in cross section, comprising a conveyor, including rollers, disposed along a generally horizontal path, an upright abutment located adjacent the path, and a pivotable arm traversing the path having a free end with a first workpiece engaging surface located to intercept the path and receive and support a workpiece from the conveyor, the surface extending laterally from the path beyond the abutment and a second workpiece engaging surface laterally offset from the path beyond the abutment and extending above the first surface.

16 Claims, 7 Drawing Sheets

20
20
13
28
54
A
46
56
30
26
38
48
22
64
37
12
24a
50
24b
62
32
40

20
26
46
56
54
A
13
30
38
28
48
22
64
37
12
24a
50
24b
62
32
40

METHOD AND APPARATUS FOR MANIPULATING THE ORIENTATION OF WORKPIECES

This application claims benefit of USC Provisional Application Ser. No. 60/002,483, filed Aug. 18, 1995.

TECHNICAL FIELD

This invention relates to an apparatus for manipulating the orientation of steel blooms or billets, and more particularly to an apparatus that can change the orientation of a steel billet or bloom in a rolling mill.

BACKGROUND ART

A variety of apparatuses are used to manipulate the orientation of blooms during steel production. Such apparatuses are used to change the position of a bloom from horizontal to vertical, to rotate a bloom, and to transfer a bloom from one location to another. Steel blooms are usually elongated and square in cross-section. These blooms are transported longitudinally while in a so-called square orientation in which a surface of the bloom along its longitudinal axis is supported by flat rollers or rolls. Steel blooms are also transferred in a diamond orientation in which an edge of the bloom is supported by rollers.

German Patent No. 634,386, dated Aug. 26, 1936, discloses rollers for transporting a billet longitudinally in the diamond orientation. The apparatus of this patent utilizes axially spaced rolls or discs that are both vertically and horizontally movable for orienting the bloom, and separate relatively wide driven rolls for supporting and conveying it along a path laterally shifted.

Another apparatus for rotating a bloom from a square orientation to a diamond orientation requires two roller tables. One table has flat rolls, while the other table has V-rolls. The bloom is originally in the square orientation on the flat roll table. A lifting mechanism is required to lift the bloom from the flat roll table, rotate the bloom and lower it onto a V-roll table. This process is expensive and cumbersome, as it requires using two tables and a lifting mechanism all at one location to rotate a bloom.

SUMMARY OF THE INVENTION

The present invention relates to a method and apparatus for lifting and reorienting a bloom that is supported on a conveyor and removing blooms from the process line. More specifically, it provides method and apparatus that lift a square bloom in the so-called square orientation from a conveyor, rotate the bloom 45 degrees to a diamond orientation, and replace it on the conveyor. This is accomplished by providing a movable support arm for raising and lowering a bloom from the conveyor. The support arm has a surface for engaging the underside of a bloom at a location where the bloom is supported by the conveyor. A hydraulic actuated cylinder provides the force to raise the arm from a first location beneath the bloom to a second location while pivoting the support arm about a radius on which the bloom rests, causing it to slide laterally from its original location on the support arm to the base of the support arm. Upon being lowered, the bloom engages an abutment adjacent to or part of the conveyor. In the preferred embodiment the conveyor roller includes the abutment. The engagement occurs at one flat side of the bloom, at a location offset laterally from the center of gravity of the bloom, and upon further lowering, the bloom rotates 45 degrees as it is replaced upon the conveyor, with the longitudinal axis in the original alignment.

The support arm may also remove a bloom from the process line. The support arm engages the underside of a bloom at a location where the bloom is supported by the conveyor. A hydraulic actuated cylinder provides the force to pivot the arm by a full stroke. This transports the bloom onto a nearby support base.

The present method and apparatus employ less equipment and have a simpler design than conventional apparatuses and as a result are less expensive and more efficient due to a fewer number of movements that are required. For example, the present apparatus can reorient the bloom using only one roller table at each movable support location. Although the present apparatus and methods may be used in many stages of workpiece handling, it has particular application in a continuous metal rolling process, positioned between a vertical stand and a horizontal stand, to rotate a steel bloom from a square to a diamond orientation without twisting the bloom between stands, which is undesirable from the standpoint of metallurgical quality.

In its broader aspects, the present invention comprises an apparatus for reorienting a bloom supported on a conveyor. The apparatus includes a movable support arm having a horizontal surface for engaging a flat underside of a bloom at a location where the bloom is supported by a conveyor and lifting the bloom from a conveyor, an actuator for raising the surface from a first location to a second location, tilting the surface from the horizontal first orientation to shift the bloom laterally, lowering the surface and returning it to the horizontal first orientation and first location, and an abutment located adjacent the conveyor and extending vertically above the movable support at a location to engage and tilt a laterally shifted bloom about a longitudinal axis of the bloom as the surface is returned to the first orientation. This operation replaces the bloom along its original path of travel.

Also in its broader aspects the present invention comprises an apparatus for reorienting a bloom supported on a conveyor and positioned in a first orientation and at a first location on the conveyor, comprising a movable support having a surface for engaging the underside of a bloom at a location where the bloom is supported by a conveyor, a first actuator for raising the surface from a first position to a second position to raise the bloom from the conveyor and return it to the first location, a second actuator for shifting the bloom laterally on the surface when the surface is raised to the second position, and an abutment located adjacent the conveyor and extending vertically above the movable support at a location to engage and tilt a laterally shifted bloom about a longitudinal axis of the bloom as the surface is returned to the first position.

Also in its broader aspects, the invention comprises a method of reorienting such a bloom supported on a conveyor, the steps of the method including raising the bloom from a conveyor, shifting the bloom laterally, lowering the bloom back to the conveyor, and rotating the bloom about its longitudinal axis as it is lowered back to the conveyor.

In a preferred embodiment, the present invention includes an apparatus for manipulating the orientation of a steel bloom supported on a conveyor, including rollers, disposed along a generally horizontal path An upright abutment is located adjacent to the path. A pivotable support arm traverses the path and has a free end with a first workpiece engaging surface located to intercept the path and receive and support a workpiece from the conveyor. The surface extends laterally from the path beyond the abutment. A second workpiece engaging surface is laterally offset from the path beyond the abutment and extends above the first surface.

The invention will become better understood from the accompanying drawings and the detailed description of preferred embodiments.

DETAILED DESCRIPTION OF PREFERRED EMBODIMENTS

Figure 1:
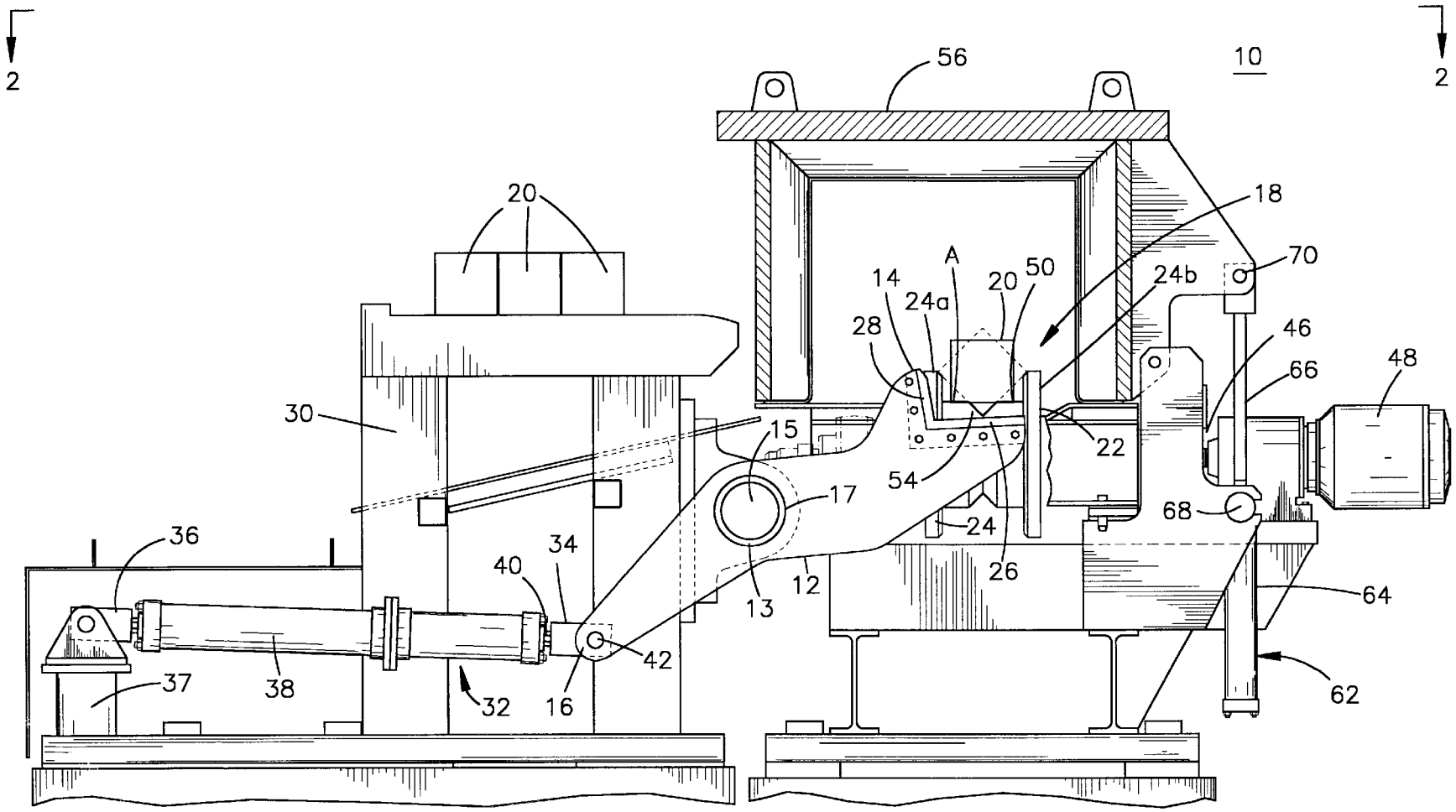
FIG. 1 is a front elevational view of a workpiece manipulating apparatus constructed in accordance with the invention.
Figure 2:
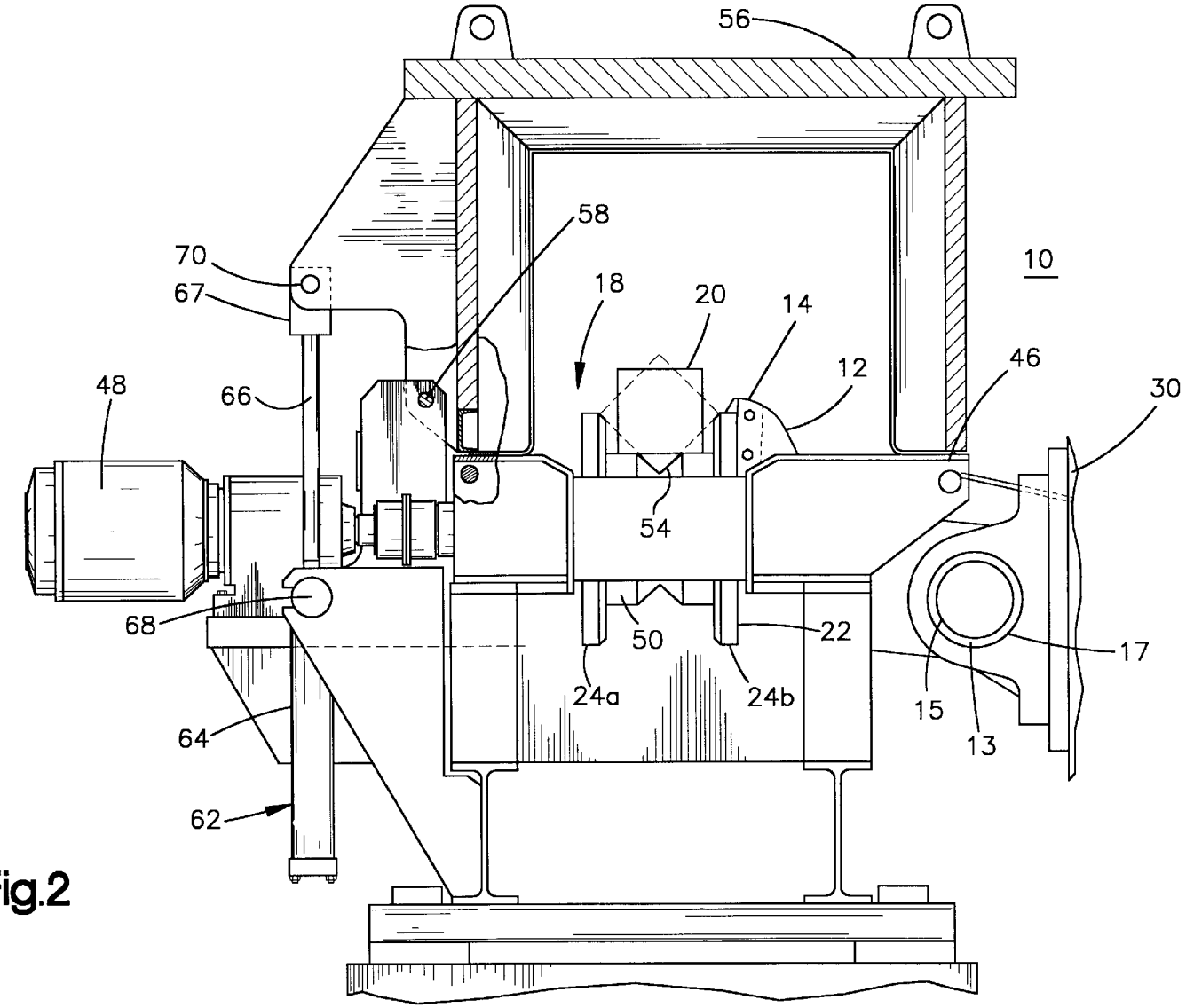
FIG. 2 is a rear elevational view of the present workpiece manipulating apparatus shown in FIG. 1.

Turning now to the drawings and to FIGS. 1 and 2 in particular, the apparatus for manipulating the orientation of steel workpieces is shown generally at 10 as including a conveyor 18 of workpieces or blooms 20 along a path A (which extends perpendicular to the direction of the page) including rollers 22 disposed in the path A. The blooms 20 are positioned on the rollers 22 in an original square orientation in which a face of the blooms 20 lies upon the rollers 22. Preferably two abutments 24*a*, 24*b* extend vertically and are located adjacent the path A. In the preferred embodiment shown, the abutments 24*a*, 24*b* are part of the rollers 22. A pivotable lever arm 12 traverses the path A having a free end portion 14 with two angularly related surfaces 26, 28 adapted to receive and lift a bloom 20 from the conveyor 18. The arm 12 is pivoted in a first direction sufficient to tilt the surface 26 to cause the bloom 20 to slide laterally on the end of the arm 12 to a position where, when the arm 12 is pivoted in a second direction to return the bloom to the rollers, the bloom 20 strikes the abutment 24*a* as it is positioned on the rollers 22, placing it along its original path, but in a diamond orientation (shown in phantom) which is rotated from the original square orientation. In the diamond orientation an edge of the bloom 20 lies against the rollers 22.

The arm 12 is movable on a pivot 13 which is preferably connected to a support base or storage table 30. The pivot 13 includes a shaft 15 and a bearing 17 about which the arm 12 is pivotably movable by a hydraulically powered cylinder. At the first end portion 14 of the arm 12 a bloom 20 is supported and transported by rotating table rolls 26. The second surface 28 of the first end portion 14 of the arm 12 extends upward from the first surface 26, at an obtuse angle as shown in the drawings. However, the second surface 28 may be formed by any member that will stop the travel of the bloom 20 on the first surface 26. Using the second surface 28 is preferred when the arm 12 is pivoted by such an angle that the workpiece 20 needs to have two surfaces supported, as when the workpiece 20 is transferred to another table. The arms 12 are preferably made of steel.

Figure 3:
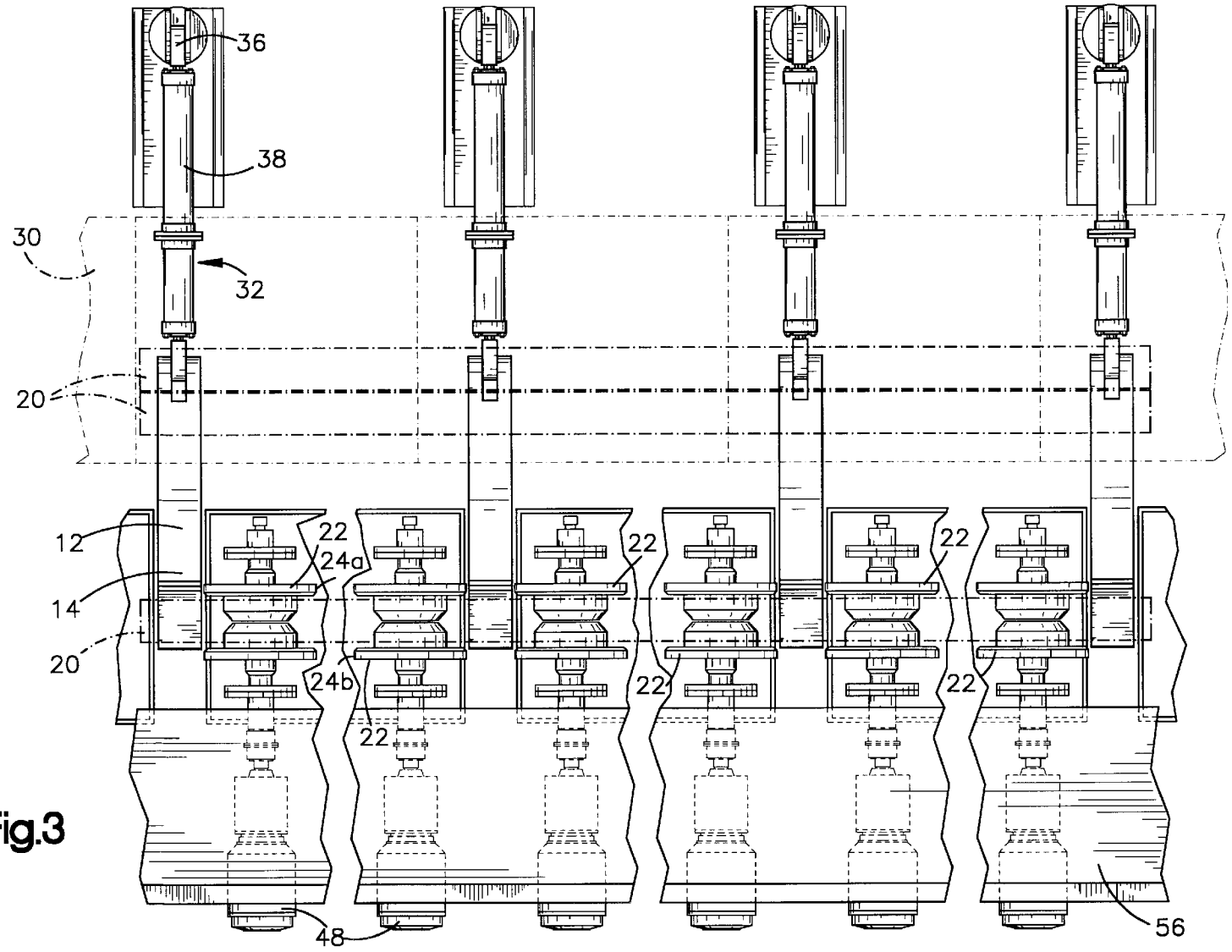
FIG. 3 is a top plan view of the present workpiece manipulating apparatus of FIG. 1, showing four arms.

Although only one arm 12 is shown, any number of arms 12 may be used at spaced locations along the path A. As shown in FIG. 3, four arms 12 are preferably used in the present apparatus 10.

Each arm 12 is connected at the second end portion 16 to an actuator such as a hydraulic piston 32, or the like. A first end portion 34 of the piston 32 is connected to the second end portion 16 of the arm 12. A second end portion 36 of the piston 32 is remote from the arm 12 and is pivotably supported on a support member 37. The piston 32 includes a cylinder 38 and a piston rod 40 which operate in the well known manner.

The piston 32 actuates the arm 12. When the piston rod 40 of the piston 32 is extended from the cylinder 38, the piston 32 pivots the arm 12 about the pivot 13 in a counterclockwise direction (as shown in FIG. 1) to either perform a first operation of rotating the orientation of the workpiece 20 or a second operation of transferring the workpiece 20 from the conveyor 18 to the table 30 when, due to problems with the workpiece 20 or the operating process, it is necessary to remove it from the path A. Conversely, when the piston rod 40 of the hydraulic piston 32 is retracted into the cylinder 38, the arm 12 is pivoted in a clockwise direction (as shown in FIG. 1) about the pivot 13, and returns the arm 12 to the conveyor 18.

The table rolls 18 are supported by a roller table 46 constructed in the well known manner. Only one roller table 46 needs to be used for process operation. The rollers 22 are preferably made of steel. The rollers 22 are powered by a variable voltage, variable frequency drive 48 in a manner known in the art. As shown in FIG. 3, two or more rollers 22 are located between successive arms 12.

Each of the rollers 22 preferably includes the abutments 24*a*, 24*b*. The rollers 22 are preferably spool-shaped and include a cylindrical roller base 50 and two spaced flanges that form the upright abutments 24*a*, 24*b*. The flanges extend beyond the cylindrical surface 50 a distance sufficient to tip the bloom to a diamond orientation when the bloom strikes a flange after being raised from the rollers and then replaced. The flanges help support the bloom in the diamond position and prevent it from tipping over. A notch 54 is formed in the cylindrical base 50. The notch 54 is preferably V-shaped, although other shapes of the notch 54 may be used as is appropriate to accommodate blooms 20 having rounded edges or the like. The flanges also help to guide the bloom into the notch 54 when the bloom is in the diamond orientation.

The workpiece manipulating apparatus 10 includes a cover 56 composed of an insulated steel frame that reduces heat loss from the workpieces 20 as they are transferred and handled on the roller table 46. The cover 56 extends along the roller tables 46 to cover the workpieces 20 along the path A. Each of the workpieces 20 is typically 77 feet long and 8½ inches square, weighs 9½ short tons and is at a temperature of 1,800°–2,000° F. Of course, the apparatus 10 can manipulate workpieces 20 of different sizes and temperatures, as should be appreciated by those skilled in the art.

The cover 56 is pivotably connected to the roller table 46. The cover 56 is actuated by a hydraulic piston 62 or the like including a cylinder 64 and a piston rod 66 (FIG. 2), and having an end portion 67. The piston 62 operates in the well known manner. The cover 56 is pivotably connected to the end portion 67 of the piston 62.

When the piston rod 66 is retracted into the cylinder 64 of the piston 62, the cover 56 is opened from its normally closed position on the conveyor 18. Conversely, when the piston rod 66 is extended from the cylinder 64, the cover 56 is closed on the conveyor 18 in the position shown in FIGS. 1 and 2.

The workpiece manipulating apparatus 10 can advantageously perform two operations. First, it can rotate the orientation of a workpiece 20 from the square to the diamond orientation. Second, it can transfer the workpiece 20 from the roller table 46 onto a storage table 30. The workpiece manipulating apparatus 10 preferably handles and conveys hot steel blooms 20 from a mill stand to a pinch roll and mill stand.

The preferred method of manipulating the orientation of the blooms 20 according to the first operation of the invention includes the steps of transporting the blooms 20 along the path A on the rollers 22 and subjecting them to successive horizontal and vertical rolling. After rolling in a mill stand the blooms 20 are in an original square orientation. One of the blooms 20 is selected for manipulation, i.e., rotation. The selected bloom 20 is then supported on the arm 12, which is pivoted in one direction a sufficient distance to lift the bloom 20 from the rollers 22 and cause the bloom 20 to slide toward the pivot 13 on the first surface 26 of the arm 12 into contact with the surface 28. The arm 12 is then pivoted in a reverse direction, toward the rollers 22, to lower the bloom 20 back to the rollers 22. Because of the sliding of the bloom 20 toward the pivot 13, the lowering causes the bloom 20 to strike the abutment 24*a* located adjacent the conveyor path A and to rotate from the original square orientation into a new diamond orientation, rotated preferably 45 degrees with respect to the original square orientation. The bloom 20 is then supported in the rotated orientation in the notches 54 of the rollers 22. Once in this diamond orientation, the bloom 20 exits the roller table 46 and enters a pinch roll and rolling mill (not shown) to complete a diamond-square rolling pass progression.

The method of manipulating the orientation of the blooms 20 according to the first operation of the invention will now be described in detail with respect to FIGS. 4A through 4E. The blooms 20 preferably exit a rolling stand and are in the original square orientation. The blooms 20 are supported on the cylindrical base 50 of the rollers 22 in this square orientation, and after they are manipulated by the apparatus 10 they will preferably be transferred to a pinch roll mechanism and a rolling stand.

Figure 4A:
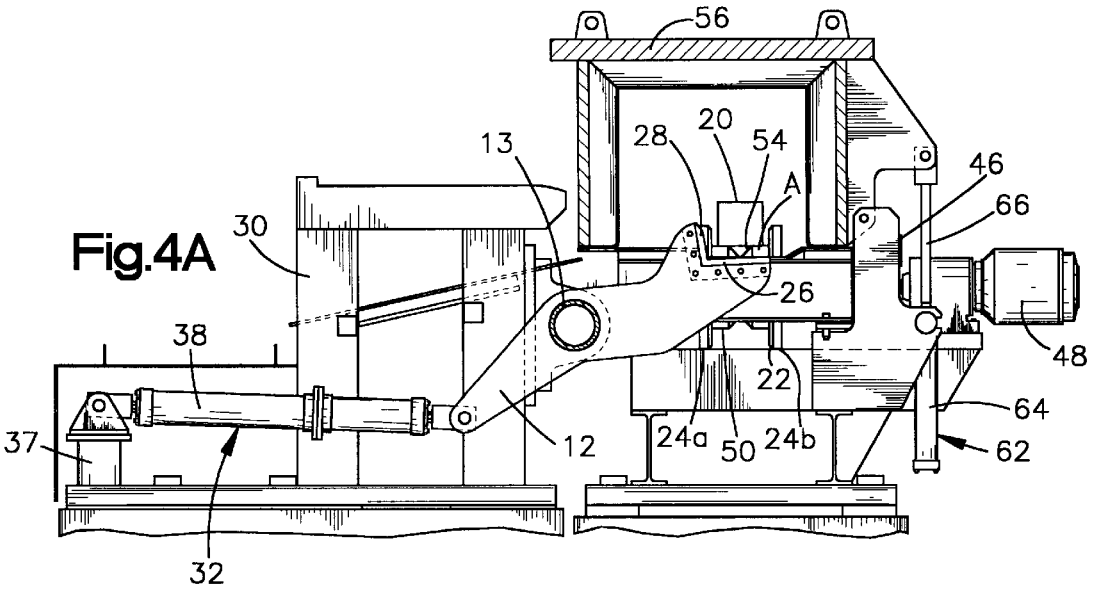
FIGS. 4A–4E are front elevational views of the present workpiece manipulating apparatus showing sequentially how a workpiece on the roller is rotated by pivoting the arm.

As shown in FIG. 4A the insulating cover 56 is in the normal closed position. A bloom 20 passes through a proximity switch that senses its location. The proximity switch sends a signal to a programmable logic controller to slow down the speed at which the rollers 22 are rotating, thus slowing down the speed at which the bloom 20 is travelling on the rollers 22. The drive 48 controls the speed of rotation of the rollers 22 during this so-called "ramp down slow down mode." The proximity switch sends a signal to the programmable logic controller to energize a disappearing steel bar stop, which is located along the path A, to enable the stop to rise. The drive 48 controls the speed at which the rollers 22 rotate during the "ramp down" so the bar stop is not severely impacted by the bloom 20.

The arms 12 are actuated only after the bloom 20 is substantially stopped. The insulating cover 56 remains closed to insulate the steel bloom 20. A Continuous Cast Direct Billet Process ("CCDBP") level II automation package logs the location of the bloom 20, acknowledging when the bloom 20 has arrived and exited the manipulation process.

Figure 4B:
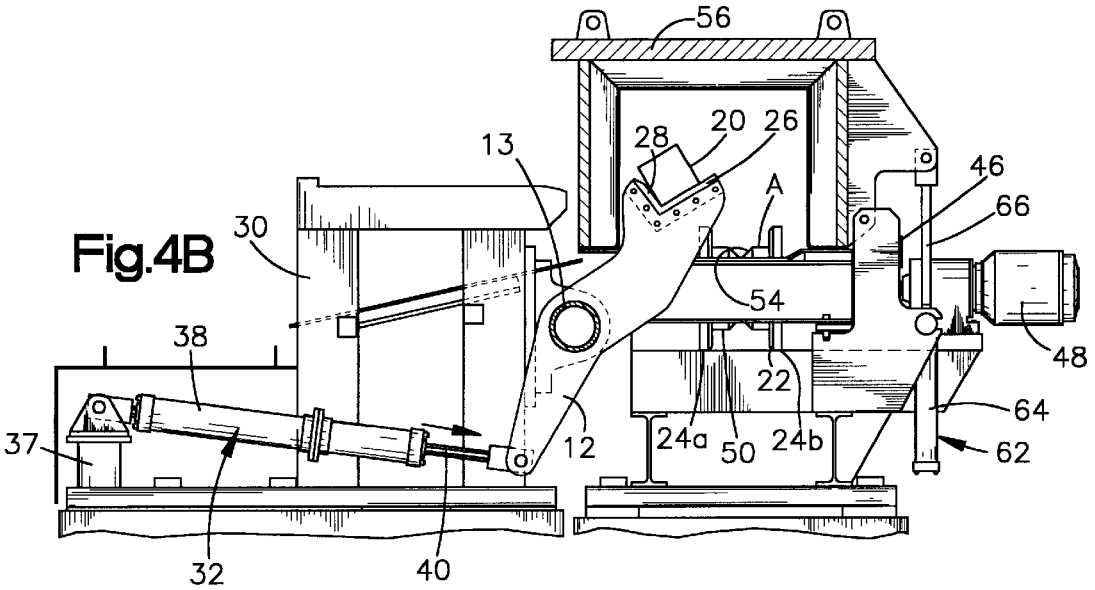

As shown in FIG. 4A, the arms 12 are positioned beneath the bloom 20 so as to traverse the path A. The first surface 26 intercepts the path A and will receive and support the bloom 20. FIG. 4B shows the workpiece manipulating apparatus 10 being energized, with the piston rod 40 partially extended, thus pivoting one of the arms 12 about the pivot 13 in the counterclockwise direction as shown in this view. As can be seen by comparing the position of the workpiece 20 on the rollers 22 in FIGS. 4A and 4B with respect to a proximity of the bloom 20 to the second surface 28 of the arm 12, the bloom 20 has slid on the first surface 26 of the arm 12 when the arm 12 pivoted away from the roller 22, until it impacted the second surface 28 of the arm 12.

Figure 4C:
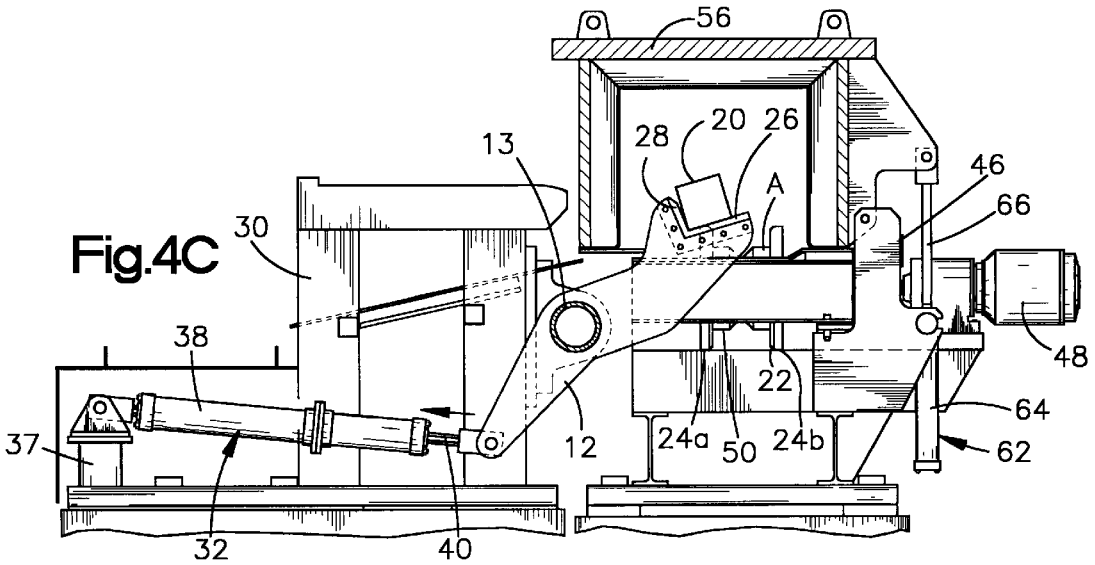

FIG. 4C shows that during the operation of rotating the workpiece 20 the piston 32 does not pivot the arms 12 counterclockwise through a full-stroke, but rather reverses direction at substantially mid-stroke and then pivots the arms in a clockwise direction. The arms 12 are pivoted away from the rollers 22 in the counterclockwise direction by extending the piston rod 40 from the cylinder 38 of the hydraulic piston 32. As shown in FIG. 4C, the piston 32 is also pivotably movable about the support member 37 during this operation. In FIG. 4C the bloom 20 has now moved along the first surface 26 of the arm 12 toward the pivot 13 a distance such that when the arm 12 is pivoted in a clockwise direction the workpiece 20 will engage the abutment 24*a* at a location offset laterally from the center of gravity, i.e., the central longitudinal axis of the bloom 20.

Figure 4D:
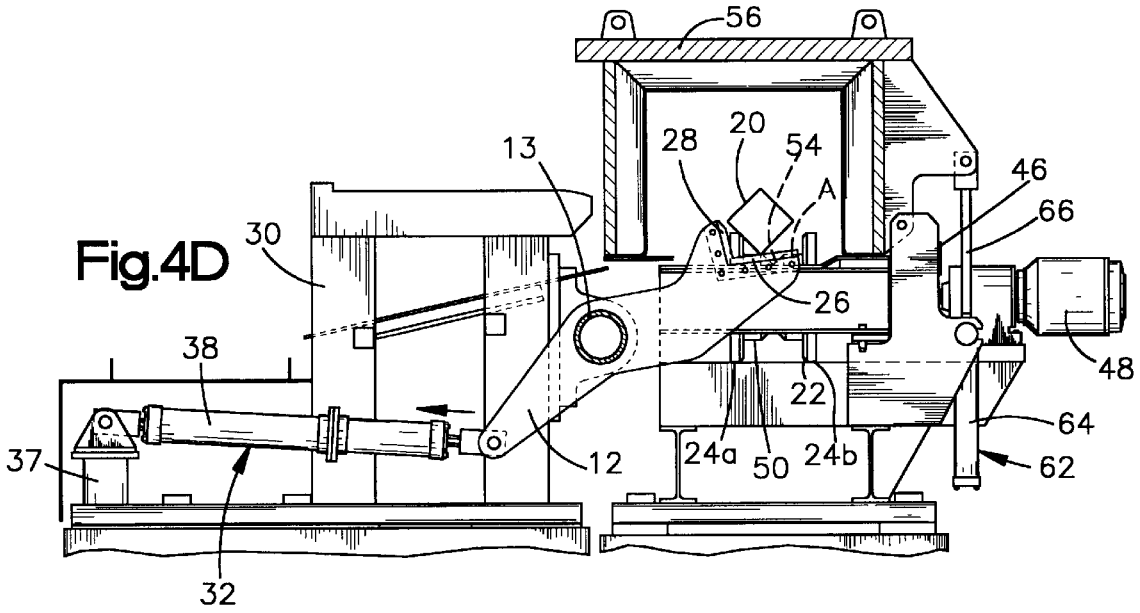
Figure 4E:
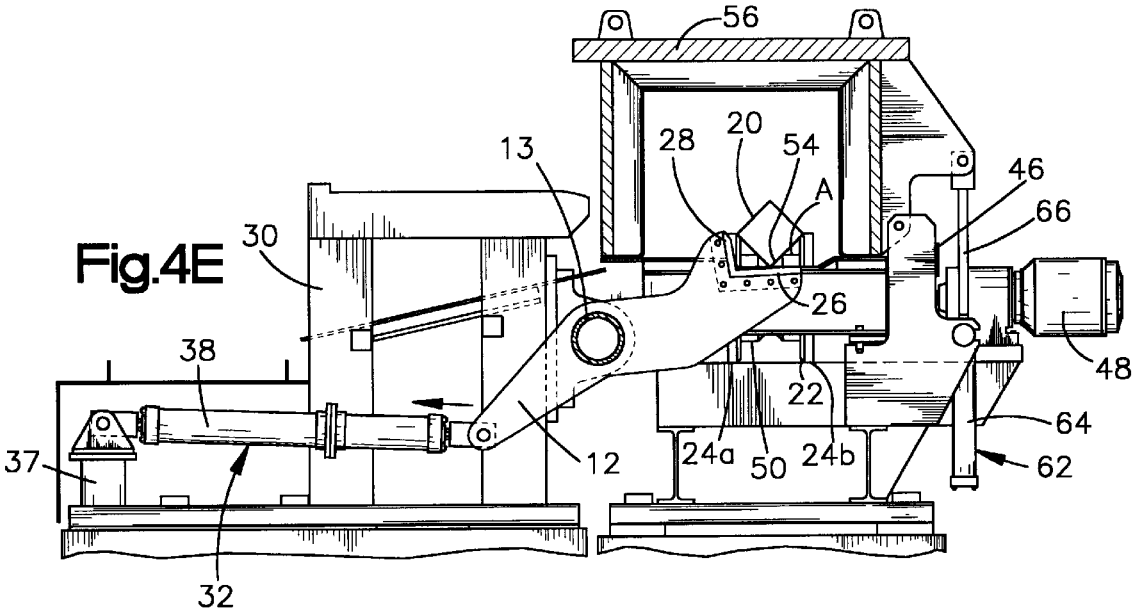

As shown in FIG. 4D, upon engaging the abutment 24*a*, the bloom 20 rotates from the original square orientation and now has an edge supported on the first surface 26 of the arm 12, and a surface supported by both the flange 24*a* and the second surface 28 of the arm 12. FIG. 4E shows completion of the workpiece rotation operation, whereby the arm 12 has returned to a position where it first supported the bloom 20 in the original square orientation. The bloom 20 has been rotated to the diamond orientation, preferably a rotation of 45° with respect to the original square orientation. The bloom 20 has been both rotated to the diamond orientation and maintained in substantially the same location along the path A that it occupied before the manipulation process. The bloom 20 is supported by the upright flanges 24*a*, 24*b* of the rollers 22 and also rests in the V-notch 54 of the rollers 22.

The bloom 20 will now be transferred to a pinch roll having a drive designed to control the speed of the bloom 20 and to support the bloom 20 in the diamond orientation such that a proper pass reduction of the bloom 20 can be accomplished. A "feed-back" closed loop controller logically located between the horizontal stand and the pinch roll will maintain proper conditions to control the diamond-square pass progression throughout the rolling mill process.

Turning now to FIGS. 5A through 5E, the method of manipulating the orientation of the blooms 20 according to the second operation of the invention is shown. This second operation is advantageously used in addition to the first rotating operation. A bloom 20 exits a rolling stand having a square cross-section and in the original square orientation, and is selected for removal from the path A. Occasionally, due to manufacturing defects, production problems and the like, it becomes necessary to remove a bloom 20 from the rolling process. The defective bloom 20 is selected for removal and removed from the path A by being transferred from the rollers 22 to the table 30.

Figure 5A:
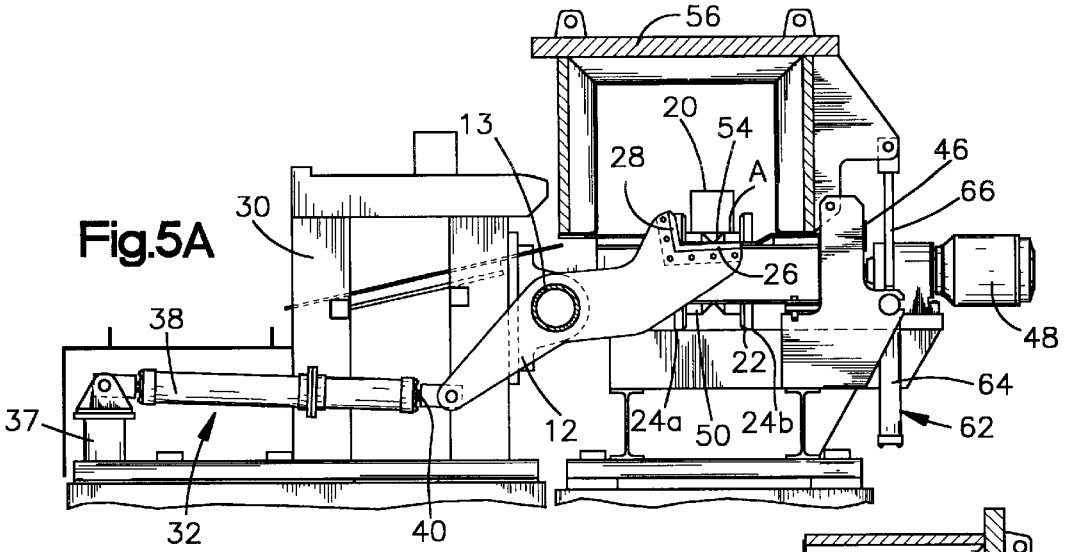
FIGS. 5A–5E are front elevational views of the present workpiece manipulating apparatus showing sequentially how a workpiece is moved to a storage table by pivoting the arm.

As shown in FIG. 5A, the cover 56 is in the normal closed position. The selected bloom 20 passes through a proximity switch that senses its location. The proximity switch sends a signal to a programmable logic controller to slow down the speed of the rollers 22 and to energize a disappearing steel bar stop to enable the stop to rise. The drive 48 controls the speed of the rollers 22 during the "ramp down" so the bar stop is not severely impacted by the bloom 20.

Figure 5B:
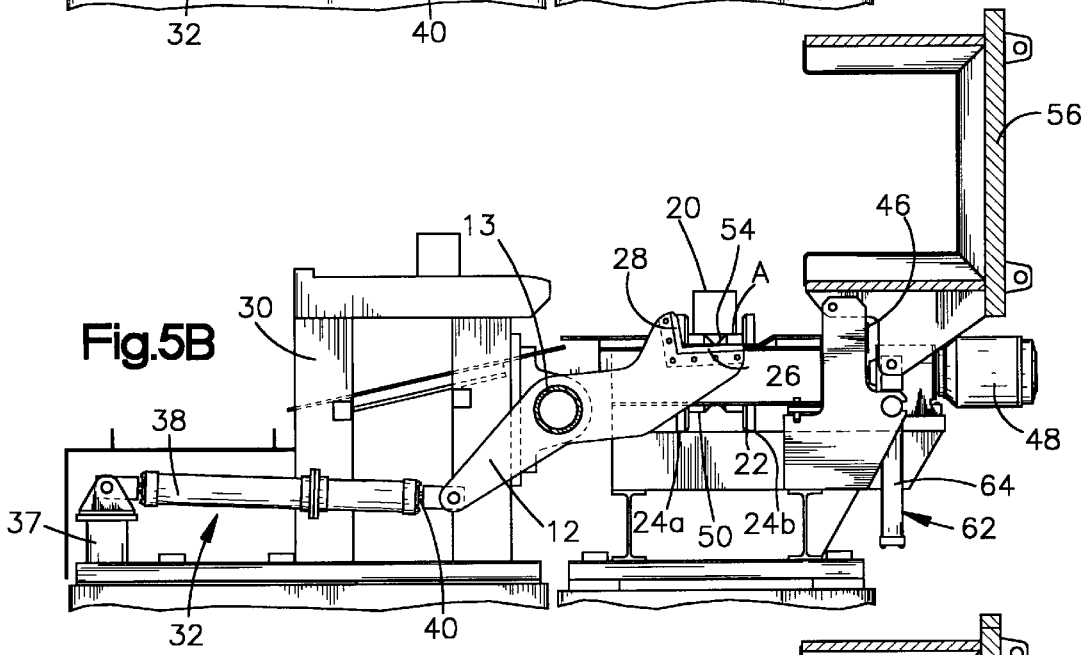

The cover 56 is opened by the piston 62. The arm 12 is actuated only after the workpiece 20 is substantially stopped by the bar stop, after the rollers 22 have stopped rotating, and after the cover 56 is opened, i.e., rotated off line (FIG. 5B). A CCDBP level II automation package logs the location of the bloom 20 and acknowledges when the bloom 20 arrives and is removed from the second operation of the manipulating process, and when to open the cover 56.

Figure 5C:
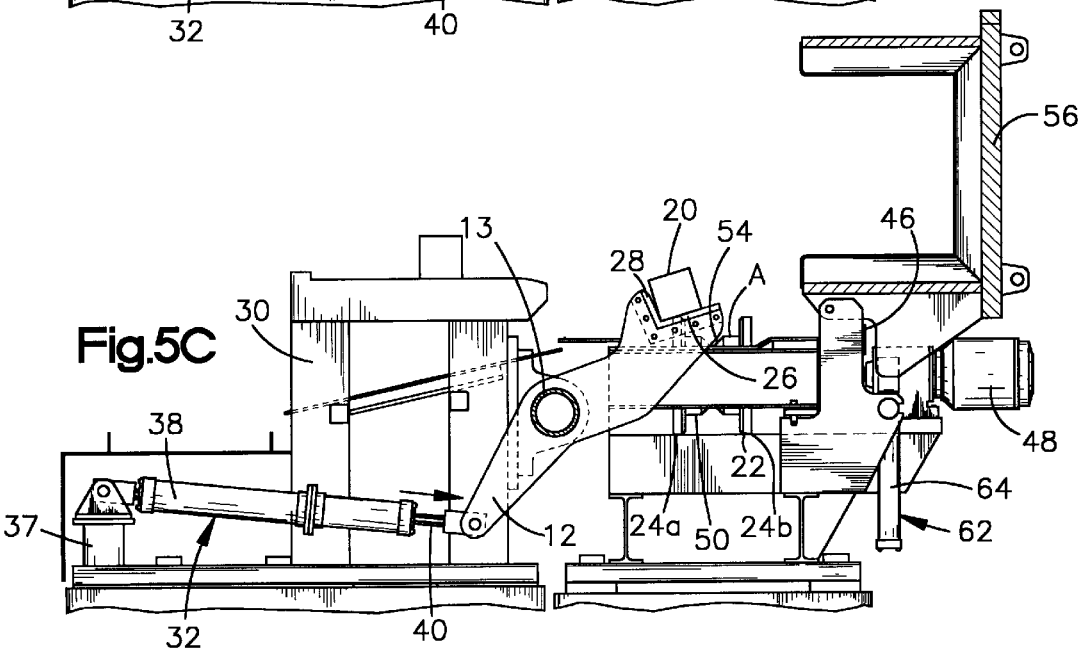

As shown in FIG. 5C, the workpiece manipulating apparatus 10 is now energized and the arm 12 lifts the bloom 20 from the rollers 22. Upon pivoting the arm 12 a sufficient amount, the bloom 20 slides on the first surface 26 of the arm 12 until it impacts the second surface 28 of the arm 12. As shown in FIG. 5C the arm 12 is pivoted in the counterclockwise direction, by extension of the piston rod 40 from the cylinder 38 of the piston 32.

Figure 5D:
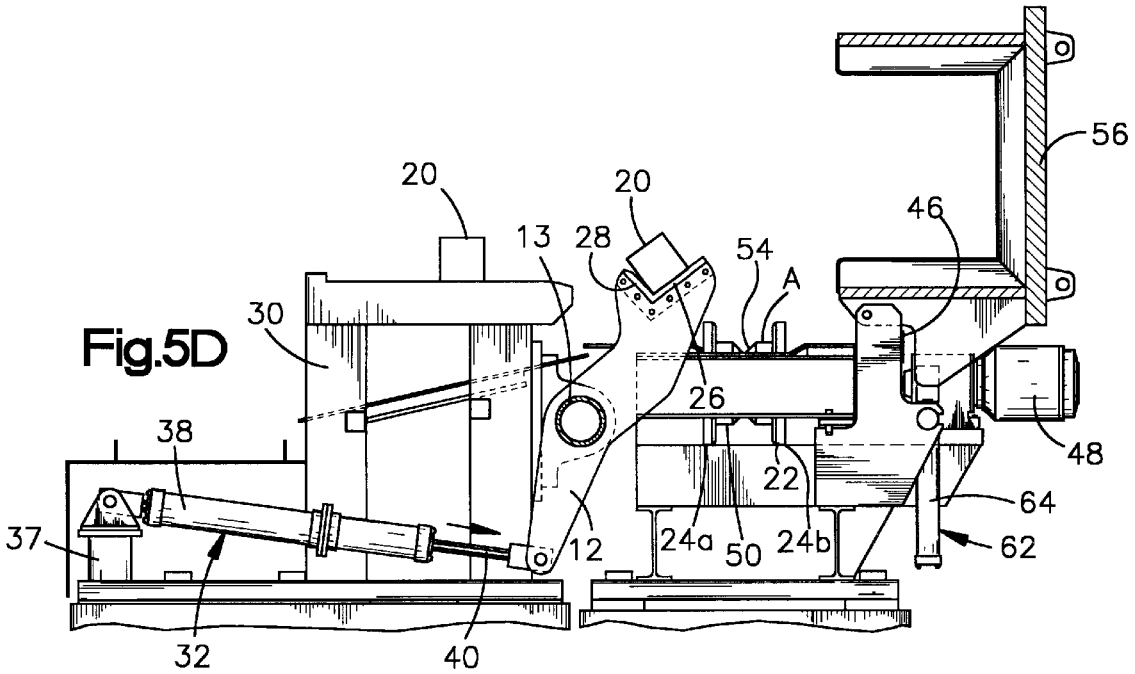
Figure 5E:
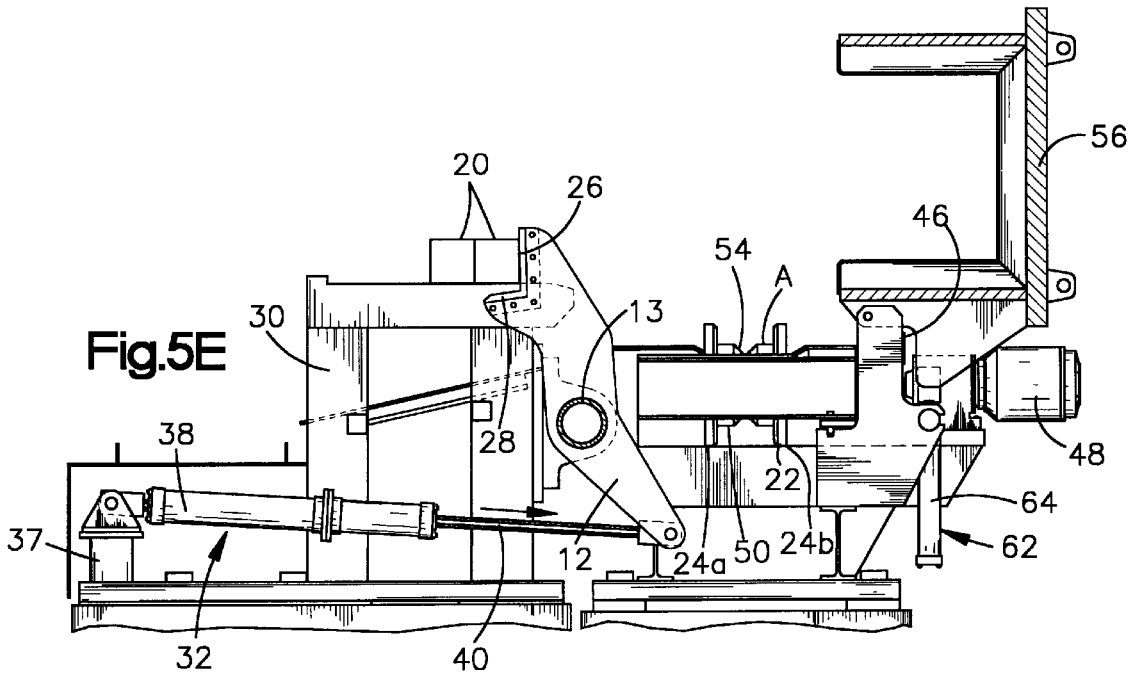

The arm 12 is pivoted still further as shown in FIG. 5D, by further extension of the piston rod 40 until completing a full-stroke as shown in FIG. 5E. At this point the piston rod 40 is at maximum extension and the bloom 20 is removed from the conveyor path A and positioned on the table 30. The table 30 preferably stores up to four blooms 20, but may be modified as necessary for additional storage.

The arm 12 is now returned to the position it first occupied when supporting the bloom 20 in the original square orientation, by being pivoted in a clockwise direction via retracting the piston rod 40 into the cylinder 38. The cover 56 is now rotated back on line into its normal closed position to cover the rollers 22 and any blooms remaining on the rollers 22 at other portions of the conveyor path A. The disappearing bar stop remains in the raised position until the support arms return to the home position.

While particular embodiments of the present invention have been illustrated and described herein, it is not intended to limit the invention to such disclosures but changes and modifications may be made therein and thereto within the scope of the following claims.

What is claimed is:

1. An apparatus for reorienting a metal bloom supported on a conveyor, said bloom being elongated and substantially square in cross section and positioned in a first orientation and at a first location on the conveyor, comprising a conveyor, including rollers, disposed along a generally horizontal path, an upright abutment located adjacent said path, a pivotable arm traversing said path having a free end with a first workpiece engaging surface located to intercept said path and engage the underside of a bloom at a location where the bloom is supported by said conveyor, said first surface extending laterally from the path beyond said abutment and a second workpiece engaging surface laterally offset from the path beyond said abutment and extending above the first surface, and an actuator for raising the first surface from a first position to a second position to raise the bloom from the conveyor, shift it laterally, lower it and return it to said first location.

wherein said abutment extends vertically above said first surface at a location to engage and tilt a laterally shifted bloom about a longitudinal axis of the bloom as said first surface is returned to said first position.

2. The apparatus of claim 1, including a plurality of abutments, each forming a part of a roller located to engage a bloom, whereby the bloom rests on the rollers.

3. The apparatus of claim 2, wherein each of the rollers is spool-shaped and comprises a cylindrical base and two spaced flanges extending from the base.

4. The apparatus of claim 3, wherein the cylindrical base of each of the rollers has a V-shaped notch between the flanges that receives an edge of the bloom.

5. The apparatus of claim 1, wherein the bloom is slidable on said first surface and the second surface extends at an angle of at least 90 degrees from the first surface.

6. The apparatus of claim 1, further comprising an hydraulic piston and cylinder apparatus adapted to actuate an end of said arm opposite to the free end of said arm.

7. The apparatus of claim 1, further comprising a holding table located adjacent the conveyor for receiving a bloom from said arm.

8. An apparatus for manipulating the orientation of steel workpieces, comprising a conveyor defining a path of workpiece travel, said conveyor comprising spool-shaped rollers spaced along the path, the rollers each having a cylindrical base, two spaced flanges and a V-shaped peripheral notch in the base midway between the flanges, and at least two pivotable arms spaced along the path, each having a free end, a first surface at the free end located to underlie the path in a first position of the arms and to intercept the path when the arms are pivoted from the first position, and on which the workpiece is supportable and slidable, and a second surface extending at an angle of at least 90 degrees from the first surface, whereby when the arms are pivoted from the first position where the first surface underlies the path to a second position above the path and then returned to the first position, the workpiece engages one of the flanges and is positioned on the rollers in a rotated orientation which is rotated 45 degrees from the original orientation.

9. A method of manipulating the orientation of steel workpieces, comprising the steps of transporting workpieces along a path on a conveyor including rollers disposed in said path, the workpieces being positioned in an original orientation on the rollers to have a surface supported by the rollers, selecting for rotation one of the workpieces disposed at a particular location along said path, supporting the workpiece on a pivotable arm having a free end adapted to receive the workpiece from the conveyor, pivoting the arm in a first direction about a point at substantially the midpoint of the arm sufficient to cause the workpiece to slide on the end of said arm, pivoting the arm in a second direction about said point to rotate the workpiece on the end of said arm toward the conveyor to cause the workpiece to contact an abutment located adjacent the conveyor path and to rotate from the original orientation into a rotated orientation in which the workpiece is rotated with respect to the original orientation, and positioning the workpiece on the rollers at said location in the rotated orientation.

10. A method of manipulating the orientation of steel workpieces, comprising the steps of transporting workpieces along a path on a conveyor, the conveyor including rollers disposed in said path on which a workpiece is positioned in an original orientation, supporting a workpiece on a pivotable arm having a free end adapted to receive the workpiece from the conveyor, pivoting said arm in a first direction away from the conveyor to lift the workpiece from the conveyor sufficient to cause the workpiece to slide on the end of said arm, pivoting said arm in a second direction toward the conveyor to cause the workpiece to strike an upright flange member located adjacent the conveyor path and to rotate from the original orientation into a rotated orientation in which the workpiece is rotated with respect to the original orientation, and supporting the workpiece on the rollers in the rotated orientation.

11. The method of claim 10, wherein when said arm is pivoted in said first direction the workpiece slides on one surface of said arm until it impacts another surface of said arm.

12. Apparatus for reorienting a bloom supported on a conveyor, said bloom being elongated and substantially square in cross section and positioned in a first orientation and at a first location on the conveyor, comprising a movable support having a surface for engaging the underside of a bloom at a location where the bloom is supported by a conveyor, an actuator for raising the surface from a first position to a second position to raise the bloom from the conveyor, shift it laterally, lower it and return it to said first location, and an abutment located adjacent said conveyor and extending vertically above said movable support at a location to engage and tilt a laterally shifted bloom about a longitudinal axis of the bloom as said surface is returned to said first position.

13. A method of reorienting a bloom supported on a conveyor, said bloom being elongated and substantially square in cross section, the steps comprising raising the bloom from a conveyor, shifting the bloom laterally while raised, lowering the bloom back toward the conveyor, contacting the bloom with an abutment located adjacent the conveyor, rotating the bloom about its longitudinal axis as it is lowered back to the conveyor, and lowering the bloom back to an original location on the conveyor.

14. The method of claim 13, including the steps of engaging a lower surface of the bloom with a lifting surface and sliding the bloom laterally on the lifting surface while the bloom is raised.

15. The method of claim 14, including the step of tilting the lifting surface as the bloom is lifted from the conveyor.

16. The method of claim 13, including the step of engaging and retarding lowering of the bloom laterally of its longitudinal axis to rotate the bloom.

* * * * *